US008937236B2

(12) United States Patent
Kunstadt

(10) Patent No.: US 8,937,236 B2
(45) Date of Patent: Jan. 20, 2015

(54) GUITAR NECK ASSEMBLY AND PROCESS THEREFOR

(71) Applicant: Robert M. Kunstadt, New York, NY (US)

(72) Inventor: Robert M. Kunstadt, New York, NY (US)

( * ) Notice: Subject to any disclaimer, the term of this patent is extended or adjusted under 35 U.S.C. 154(b) by 32 days.

(21) Appl. No.: 13/694,515

(22) Filed: Dec. 7, 2012

(65) Prior Publication Data

US 2014/0157968 A1 Jun. 12, 2014

(51) Int. Cl.
*G10D 3/14* (2006.01)
*G10D 3/06* (2006.01)
*G10D 1/08* (2006.01)

(52) U.S. Cl.
CPC ... *G10D 3/06* (2013.01); *G10D 1/08* (2013.01)
USPC ..... 84/314 R

(58) Field of Classification Search
USPC ..... 84/314 R, 290, 293, 267
See application file for complete search history.

(56) References Cited

U.S. PATENT DOCUMENTS

| | | | | |
|---|---|---|---|---|
| 5,631,432 | A | 5/1997 | Muncy | |
| 6,350,940 | B1 * | 2/2002 | Upchurch et al. | 84/314 R |
| 7,256,336 | B2 | 8/2007 | Muncy | |
| 2003/0164081 | A1 * | 9/2003 | Booker | 84/314 R |
| 2006/0174748 | A1 * | 8/2006 | Buhoveckey et al. | 84/314 R |

* cited by examiner

*Primary Examiner* — Kimberly Lockett

(57) ABSTRACT

In a stringed instrument such as a guitar, a fingerboard is slidably engaged with the instrument's neck, preferably by means of flanges that engage with corresponding grooves along the lateral edges of the neck.

6 Claims, 4 Drawing Sheets

GUITAR NECK ASSEMBLY AND PROCESS THEREFOR

FIELD OF THE INVENTION

This invention relates to the field of necks for stringed musical instruments known as guitars, including bass guitars.

SUMMARY OF THE INVENTION

In the present invention, the fingerboard is slidably engaged with the instrument's neck, preferably by means of flanges that engage corresponding grooves provided along the lateral edges of the neck.

DETAILED DESCRIPTION OF THE INVENTION

Referring now to FIGS. 1-8, the invention will be described in detail.

Figure 1:
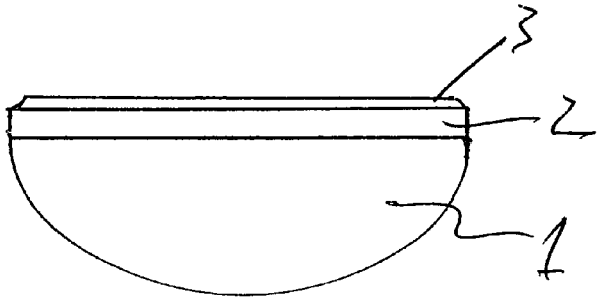
Fig. 1 (PRIOR ART)
FIG. 1 is a cross-section of an assembled guitar neck according to the PRIOR ART.

Referring now to FIG. 1, some typical parts of a prior art neck assembly can be seen. Neck 1 is provided with fingerboard 2, generally held together by adhesive means such as hide glue. Fingerboard 2 is provided with a plurality of frets 3, generally friction-fit into fingerboard 2. The assembly shown in FIG. 1 is a classical guitar, since there is no radius on the fingerboard. Steel-string guitars generally have a radius, e.g., 12".

Figure 2:
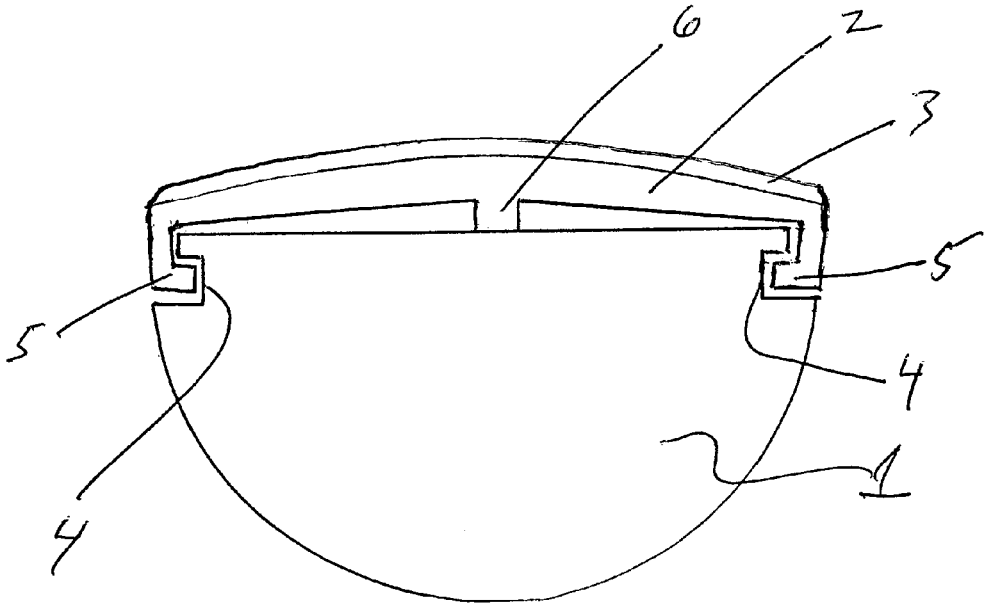
FIG. 2 is a cross-section of an assembled guitar neck according to an embodiment of the invention, taken at A-A of FIG. 6.

Referring now to FIG. 2, an embodiment of the invention is shown in cross-section. Neck 1 is provided with fingerboard 2 which is slidably engagable therewith. Said sliding engagement may be accomplished by means of the grooves 4 provided along each of the left and right lateral edges of neck 1. Corresponding flanges 5 are provided upon fingerboard 2, which matingly engage grooves 4.

Boss 6 extends along the centerline of fingerboard 2 and serves to elevate it to form a central ridge that provides a radius to the top of said fingerboard 2. Frets 3 may be provided integral with fingerboard 2.

Figure 3:
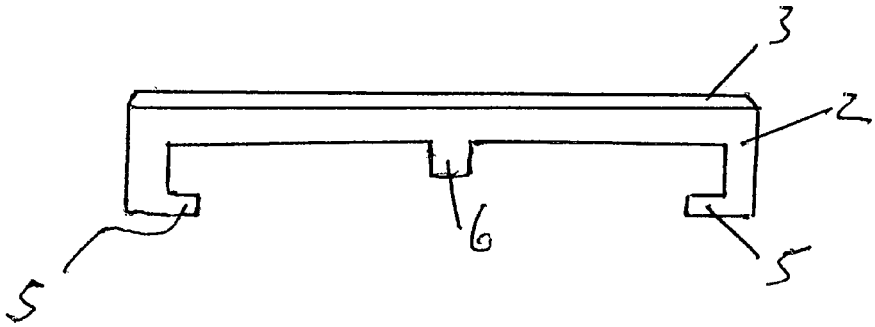
FIG. 3 is a cross-section of a fingerboard according to said embodiment of the invention, prior to assembly.

Referring now to FIG. 3, it may be appreciated that the natural relaxed state of fingerboard 2 is flat. The fact that it is deformed slightly in order to force it into mating engagement with grooves 4 of neck 1 (as seen in FIG. 2), insures that fingerboard 2 can retain its position upon neck 1 by the force of spring tension, without need for fasteners, adhesives, or the like.

The fact that the shape is flat is significant in the case of manufacture by 3D printing, since the tops of flat frets are smooth when 3D printed, for example by the process of fused deposition modeling (FDM). If one tried to 3D print a curved radius by FDM, the tops of the fretboard and the tops of the frets would be discontinuous—due to layering into slices by the printer resulting in "jaggies"—and therefore rough to the touch and unsatisfactory for use in a guitar which is necessarily fingered by the player and hence is expected to feel smooth.

Boss 6 may be of a height chosen to be sufficient to impart the desired radius to the naturally-flat fingerboard 2, upon its assembly onto neck 1.

In a preferred embodiment, neck 1 may be made from aluminum; and fingerboard 2 (including its integral frets 3) may be made from an ABS blank (made by 3D printing) which is plated with nickel (for resistance to abrasion from string wear).

Fingerboard 2 can be manipulated to slide on (and off) of neck 1, for example for purposes of changing the radius.

Figure 4:
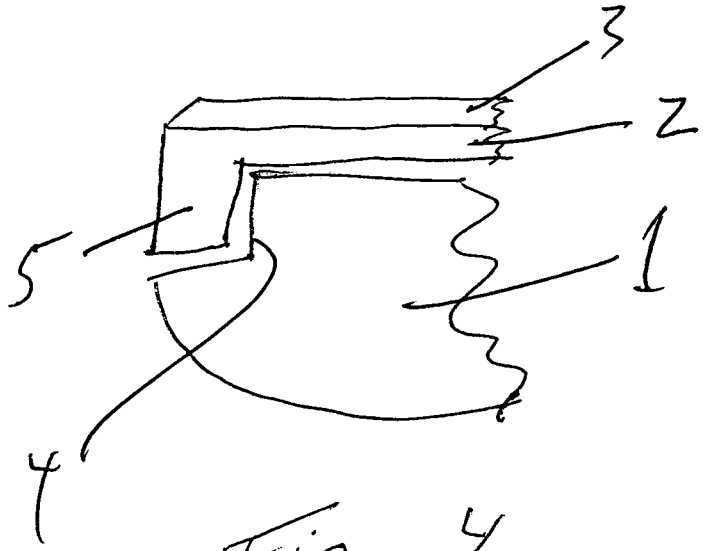
FIG. 4 is a partial cross-section of an assembled guitar neck according to another embodiment of the invention.

Referring now to FIG. 4, an alternate embodiment may have a neck 1 of wood. Fingerboard 2 may be affixed thereto by adhesive; and it may be positioned in a groove 4 having an open top (rather than a closed top as shown in FIG. 2).

Figure 5:
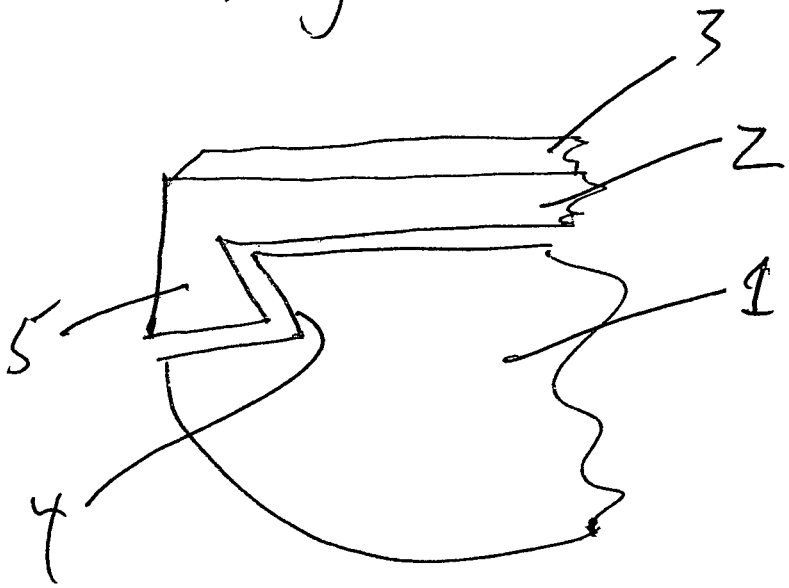
FIG. 5 is a partial cross-section of an assembled guitar neck according to yet another embodiment of the invention.

Referring now to FIG. 5, another alternate embodiment may have a neck 1 of wood. Fingerboard 2 may be positioned in groove 4 having a closed top (in an outwardly-angled configuration) for retaining fingerboard 2 upon neck 1.

As used herein, "closed" as applied to the top of groove 4, means that flange 5 cannot escape upwardly from groove 4.

Figure 6:
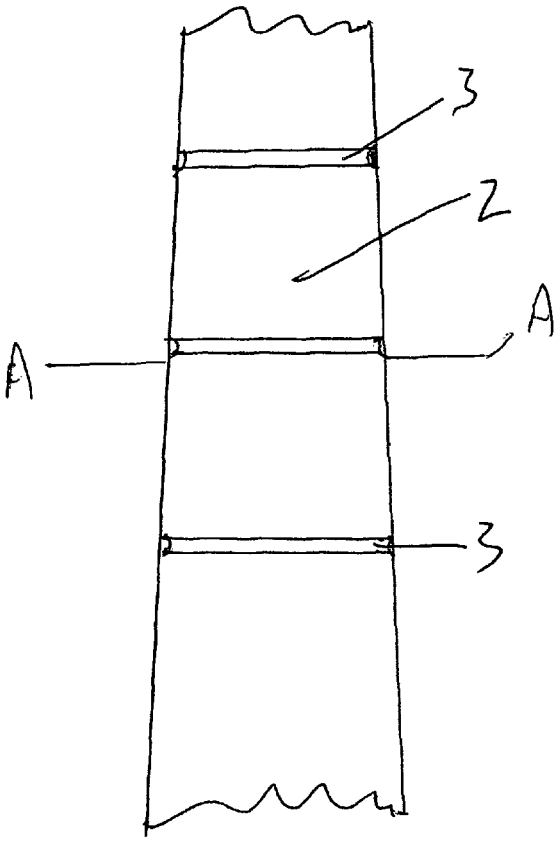
FIG. 6 is a top plan view of a segment of a fingerboard according to an embodiment of the invention.

Referring now to FIG. 6, a segment of a fingerboard according to the invention may be seen. Frets 3 may be formed integral with fingerboard 2 as a unit, starting with a plastic blank made by 3D printing, then plated with metal such as nickel for durability to resist abrasion from the strings of a guitar.

Figure 7:
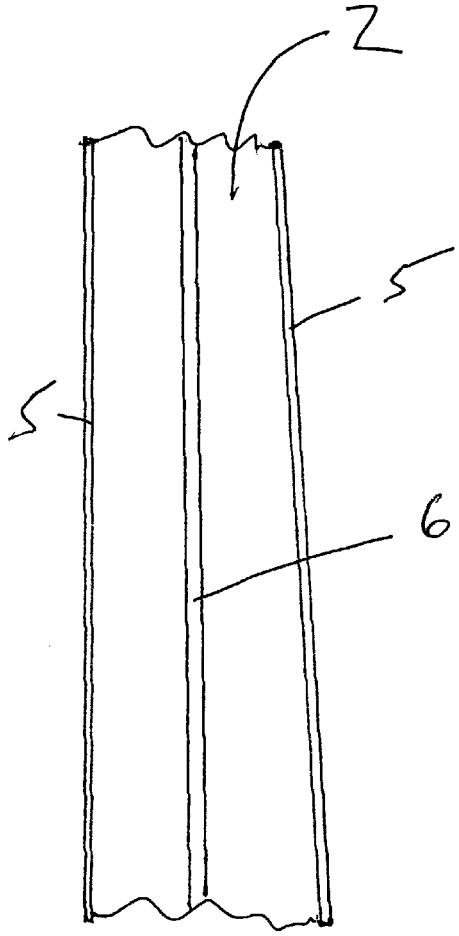
FIG. 7 is a bottom plan view of a segment of a fingerboard according to an embodiment of the invention.

Referring now to FIG. 7, a segment of fingerboard 2 according to the invention may be seen from the bottom. Boss 6 may run substantially the length of fingerboard 2, or it may be interrupted. Boss 6 may be chosen of a height sufficient to impart the desired radius to frets 3, when assembled on neck 2.

Note that as shown in FIG. 3, the natural relaxed state of fingerboard 2 with its frets 3 may be flat on top. However, fingerboard 2 is bent in a radius when it is slid onto neck 1, and the action of bending it deforms it—thereby setting up an internal spring force by which it attempts to resume its natural relaxed configuration. Such internal spring force may, according to an embodiment of the invention, serve as the means for retaining fingerboard 3 on neck 1—without need for screws, adhesive or other fastener means. When it is desired to remove fingerboard 2 from neck 1, it may be slid off. A simple hand tool such as a light wooden mallet may advantageously be employed in the process of sliding it on and off, by gentle taps upon one end or the other.

Figure 8:
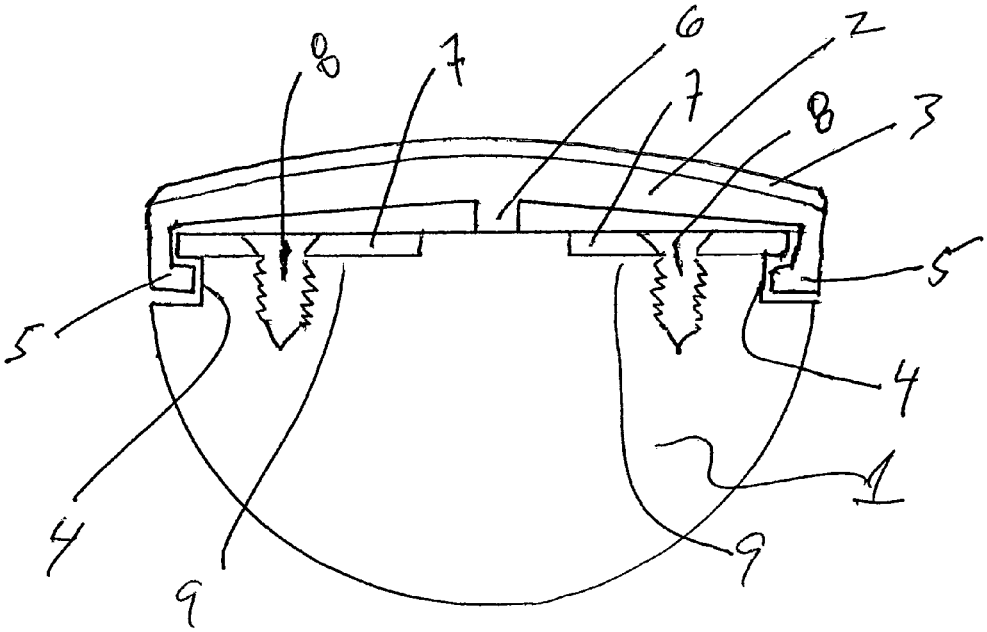
FIG. 8 is a cross-section of an assembled guitar neck according to an another embodiment of the invention, taken at A-A of FIG. 6.

Referring now to FIG. 8, neck 1 may be of wood and it may be provided with inlays 7, retained by screws 8 in beds 9 routed into neck 1 for receiving inlays 7. In this embodiment, closed tops for grooves 4 may advantageously be provided by inlays 7, which may be made of metal such as aluminum, steel or titanium; or plastic such as nylon or teflon. Thereby, the risk of splitting the wood of neck 1 is minimized. Instead of or in addition to screws 8, adhesive may be utilized.

By utilizing expedients such as shown and described, it may be possible to mass-produce assembled guitar necks, ready to play, that are light in weight; comfortable to hold; resistant to warping and string wear; uniformly and consistently well-intonated; with low action; and easy for both experts and beginners to play well. Due to the resonant properties of such necks, they may provide superior tonal quality including long sustain; even response at all fret positions; and singing high overtones optimized to "cut through the mix" in live band performances and on recordings.

The invention is not limited to the exact embodiments shown and described, and may be realized in such other ways as will be apparent to the skilled artisan, utilizing the teachings of the invention.

The invention claimed is:

1. An assembly of a guitar neck with a fingerboard having frets, said fingerboard being provided with flanges along its lateral edges; said neck being provided with grooves along its lateral edges; said flanges being slidably engageable in said grooves; said fingerboard being provided with at least one boss along its underside; said boss being of a height sufficient to radius said fingerboard.

2. An assembly according to claim 1, said neck being aluminum and said fingerboard being nickel-plated plastic.

3. A fingerboard for a guitar, said fingerboard being provided with flanges along its lateral edges; and said fingerboard being provided on its underside with at least one boss substantially down its centerline.

4. An assembly of a guitar neck with a fingerboard having frets, said fingerboard being provided with flanges along its lateral edges; said neck being provided with grooves along its lateral edges; said flanges being slidably engageable in said grooves; said neck having first and second lateral edges; said neck being provided with a first closed-top groove along said first lateral edge and a second closed-top groove along said second lateral edge.

5. A process comprising preparing a flat blank for a fingerboard; plating said blank; deforming said fingerboard to form a radius; and affixing said deformed fingerboard to a neck; in which said plating is nickel plating; said neck is laterally provided with closed-top grooves; and said affixation is by the resilience of said fingerboard applied to said grooves.

6. The process of claim 5, in which said fingerboard is deformed by a boos to form a radius.

* * * * *